US005512093A

United States Patent [19]

Huege et al.

[11] Patent Number: 5,512,093

[45] Date of Patent: Apr. 30, 1996

[54] HOT MIX ASPHALT AND METHOD OF PREPARATION THEREOF

[75] Inventors: Fred R. Huege, Colleyville, Tex.; Robin E. Graves, Henderson, Nev.; Timothy L. Salter, Fort Worth, Tex.; Patrick Shields, Scottsdale, Ariz.; Norman L. Hains, Arlington, Tex.

[73] Assignee: Chemical Lime Company, Fort Worth, Tex.

[21] Appl. No.: 329,436

[22] Filed: Oct. 26, 1994

[51] Int. Cl.[6] ..... C09D 4/00

[52] U.S. Cl. ..... 106/284.03; 106/284.04; 106/792

[58] Field of Search ..... 106/284.04, 792, 106/793, 284.03; 404/17, 72

[56] References Cited

U.S. PATENT DOCUMENTS

| | | | |
|---|---|---|---|
| 783,570 | 2/1905 | Ellis . | |
| 1,095,180 | 4/1914 | Carson | 106/793 |
| 1,249,997 | 12/1917 | Olson | 106/793 |
| 1,277,855 | 9/1918 | Carson . | |
| 1,576,045 | 3/1926 | Greene | 106/284.04 |
| 1,579,766 | 4/1926 | Hite . | |
| 1,664,598 | 4/1928 | Dittlinger . | |
| 2,044,553 | 6/1936 | Welch . | |
| 2,192,284 | 3/1940 | Dahlberg . | |
| 4,233,015 | 11/1980 | Teague et al. | 405/263 |
| 4,329,090 | 5/1980 | Teague et al. | 405/263 |
| 4,464,353 | 8/1984 | Hains . | |
| 5,037,480 | 8/1991 | Baker | 106/793 |
| 5,332,436 | 7/1994 | Walker, Jr. et al. | 106/792 |
| 5,401,312 | 3/1995 | Harst | 106/706 |

FOREIGN PATENT DOCUMENTS

| | | | |
|---|---|---|---|
| 7403475 | 9/1975 | Netherlands | 106/792 |
| 0001704 | of 1862 | United Kingdom | 106/792 |

*Primary Examiner*—Paul Marcantoni
*Attorney, Agent, or Firm*—Charles D. Gunter, Jr.

[57] ABSTRACT

A method is shown for improving the properties of hot mix asphalt by treating the aggregate which is combined with bituminous binder with lime. A hot quicklime slurry is produced by slaking quicklime with water at the site of the hot mix asphalt plant using a portable mixing tank. The hot quicklime slurry is then applied to the aggregate, the aggregate is dried and combined with the binder to produce the hot mix asphalt.

15 Claims, 1 Drawing Sheet

HOT MIX ASPHALT AND METHOD OF PREPARATION THEREOF

BACKGROUND OF THE INVENTION

1. Field of the Invention

The present invention relates generally to improvements in the art of making bituminous substrates, such as roadways, employing hot mix asphalt in which the surfaces of the aggregate to which the bitumen is applied are treated in order to improve the binding characteristics between the aggregate and the bitumen binder and to render the bond more highly resistant to water.

2. Description of the Prior Art

Since the early 1930's, asphalt surface course has been widely used for both private and public roadways. Hot mix asphalt is comprised of sand as one component, an aggregate or mineral component, and asphalt. The type of aggregate used may vary widely depending upon such factors as the cost and availability of the aggregate, as well as the particular application of the asphalt. Granite, quartz and limestone minerals, for example, can all be used as an aggregate material in forming hot mix asphalt. Asphalt forms the continuous phase and acts as a binding agent for the mineral aggregate. The continued preservation of bond between the asphalt and rock or mineral content of the composition is necessary to insure a lasting pavement. Water, natural weathering and traffic loading are often responsible for adhesion failure which occurs between the asphalt and the aggregate.

Hydrated lime has been known to be an effective additive for reducing adhesion problems of the type previously described. In the period from about 1910 to 1930, there were common applications of 1–2% hydrated lime in asphalt paving mixtures. A few states specified hydrated lime in their state standards. Lime provided a combination antistripping agent and mineral dust filler. Unaccountably, the use of lime for this purpose nearly disappeared in the period from about 1930 to about 1957. Apparently, since mineral dust fillers were specified by state highway departments, asphalt contractors chose to use less costly fillers than hydrated lime. Certain organic antistripping compounds also replaced hydrated lime, in spite of their higher cost. See, Chemistry and Technology of Lime and Limestone, Boynton, 2nd Edition 1980, Chapter 11.

In the late 1950's, the Colorado Highway Department adopted the "immersion-compression" test for analyzing moisture effects on bituminous mixtures. This test measured compression of asphalt specimens both dry after oven curing and wet after immersion in water and demonstrated impressive advantages for hydrated lime with certain types of asphalt-aggregate mixtures. Thus, in more recent years, many states have specified the use of 1% hydrated lime in many of the public paving projects.

While various techniques have been employed to add lime to the aggregate component of bituminous mixes, by far the preferred method in actual use was to mix dry hydrated lime with the aggregate. Typically, about 1% by weight, based on the mineral component, was used. There are many problems associated with the use of dry hydrate including dusting and poor performance when mixed with dry aggregate. As a result, the State of California recently approved the use of hydrated lime slurry rather than dry hydrate. The dry hydrated lime is slurried with water at about 20–25% solids and the slurry is used to treat the mineral component of the hot mix asphalt.

While the use of hydrated lime slurry can help to eliminate dusting and other problems associated with the use of dry hydrate, other problems have remained. The extra water provided by a hydrated lime slurry is undesirable since the aggregate must by dried before mixing with the asphalt. Hydrated lime is more expensive than quicklime and can require the presence of extra tanks, silos and mixing equipment at the hot mix plant. Also, when quicklime is slaked to produce hydrated lime by a traditional slaking process, the resulting % solids of the slurry is usually low, on the order of 15–30% solids. This means that 5.7 to 2.3 times more water would be added to the aggregate being treated than lime. Thus, if 1% Ca(OH) 2 were being added to the mineral component at 15% solids, this would mean an increase in the moisture content by 5.7% which would require additional drying at considerable cost in money and production time. At 30% solids, addition of 1% Ca(OH) 2 would similarly mean the addition of 2.3% water.

The present invention has as its principal object to eliminate the previously mentioned shortcomings with lime slurry treatment of aggregate used in bituminous mixes, such as hot mix asphalt.

Thus, it is one object of the invention to provide an improved method for treating the aggregate used in hot mix asphalt through the use of a hot slurry prepared from quicklime rather than from dry hydrate.

Another object of the invention is to provide a slurry produced from quicklime for treating the mineral component of hot mix asphalt which slurry has a higher percent solids than traditional slurries used for this purpose.

Another object of the invention is to produce such an improved slurry from quicklime which has an increased temperature over hydrated lime slurries which can be added hot to the aggregate to cause increased evaporation of water and thus lower the requirements for additional heat to dry the treated aggregate.

Another object of the invention is to provide such a hot slurry having a lower viscosity, thus providing improved mixing of the Ca(OH)2 particles in the slurry with the sand and aggregate in the bituminous mix.

SUMMARY OF THE INVENTION

The present invention meets the previous objects by treating the aggregate material used in hot mix asphalt compositions with calcium hydroxide prior to combining the aggregate material with a bituminous binder. In practicing the method of the invention, unslaked quicklime is selected as the starting source of calcium hydroxide. The unslaked quicklime is mixed together with an aqueous slaking medium in a mixing tank to form a quicklime slurry which now contains calcium hydroxide. The resulting quicklime slurry has a lime solids content greater than about 30% by weight, based upon the total weight of the quicklime slurry. Preferably, the lime solids content of the quicklime slurry is in the range from about 30 to 60% by weight more preferably in the range from about 32 to 40 % by weight, based upon the total weight of the quicklime slurry.

The step of forming the quicklime slurry can include the additional step of adding a soluble sulfate compound to the slaking medium prior to contacting the quicklime with the slaking medium and then contacting the quicklime with the slaking medium to directly form a flowable and pumpable lime slurry having a solids content greater than about 35% by weight. The aqueous slaking medium is preferably water and the soluble sulfate compound is preferably a member selected from the group consisting of alkali metal and alkaline earth sulfates, organic sulfates, sulfuric acid and mixtures thereof. The soluble sulfate compound, such as gypsum, can also be mixed with the quicklime with the mixture then being added to the slaking medium.

In an especially preferred form of the present invention, the aggregate used in forming the hot mix asphalt composition is treated with a hot quicklime slurry. The method includes the steps of mixing together in a slurry mixing tank unslaked quicklime and an aqueous slaking medium to form a hot quicklime slurry at elevated temperature above ambient, the resulting hot quicklime slurry having a lime solids content greater than about 30% by weight, based upon the total weight of the quicklime slurry. Before the hot quicklime slurry cools below ambient temperature and while the hot slurry is at a temperature above ambient, the hot quicklime slurry is applied to the aggregate material. The treated aggregate material is dried and combined with bituminous binder to form a hot mix asphalt. Also, organic dispersants such as sodium polyacrylates can be added to the water prior to slaking or after slaking to lower the viscosity and increase the solids content of the slurry.

Additional objects, features and advantages will be apparent in the written description which follows.

DETAILED DESCRIPTION OF THE INVENTION

Figure 1:
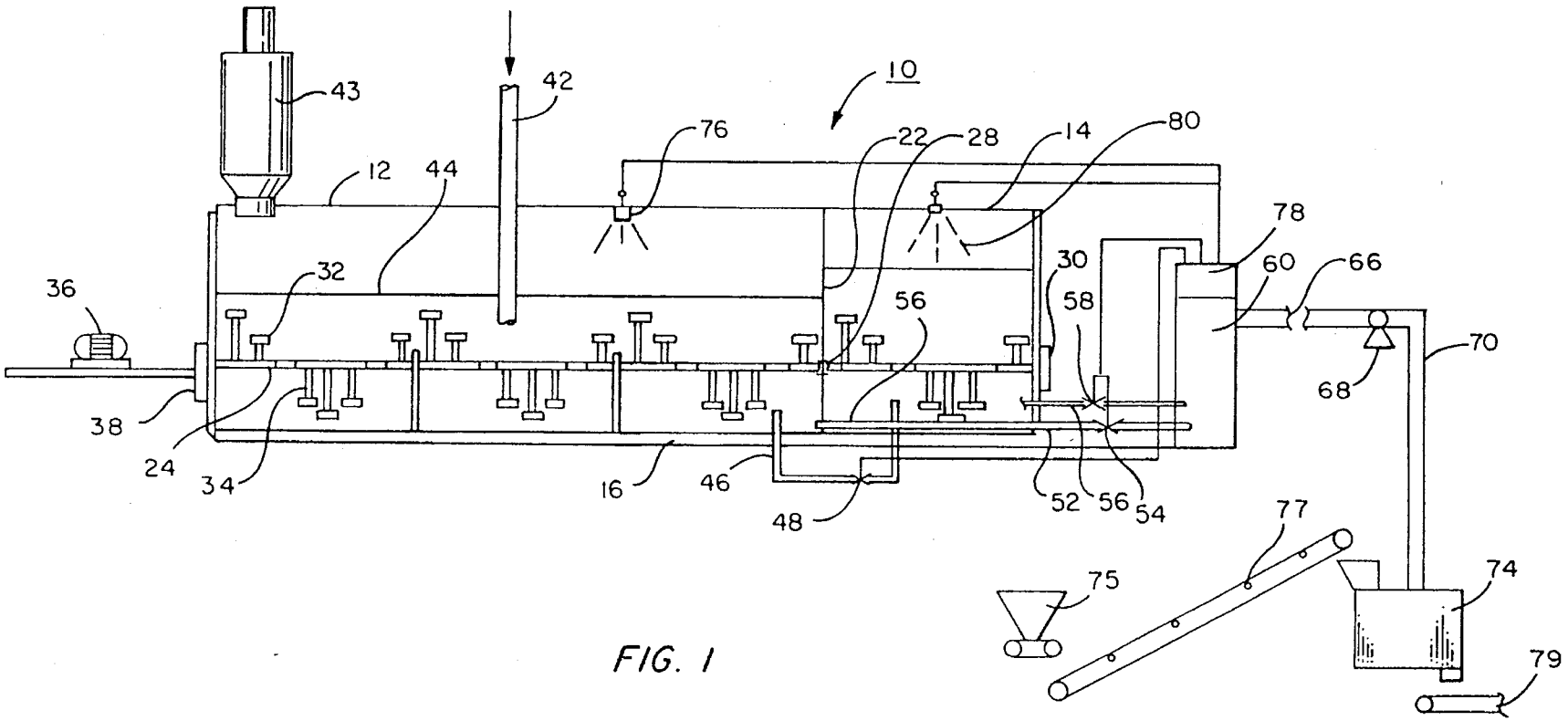
FIG. 1 is a partial cross sectional view, partly schematic, illustrating a mixing apparatus of the type used for slaking quicklime in water according to the method of the present invention.

The use of lime, in various forms, has been shown to improve the retention of asphalt coating under moisture, weathering and loading conditions in asphalt-aggregate systems such as hot mix asphalt. Various theories have been advanced to explain this phenomenon. It is theorized that the lime decreases the interfacial tension between the asphalt and water, thus resulting in good adhesion. It is also thought that the hydrated lime improves the stripping resistance by interacting with the carboxylic acids in the asphalt. This interaction forms insoluble products that are readily adsorbed onto the surface of the aggregate. Some studies indicate that strong adsorption of calcium onto mineral aggregate surfaces may contribute to bonding of asphalt cements with the aggregate. Lime also has the additional advantage of functioning as a mineral filler which results in a stiffening of the asphalt binder in addition to acting as an antioxidant.

While it is generally agreed that the amount of lime added to the aggregate should be between about 1.0 to 1.5 % by weight, based upon the weight of aggregate, there is no general agreement on the best method for adding the lime to bituminous mixtures such as hot mix asphalt. At least four different methods have been used to greater or lesser extents as summarized in Hanson et al, "Laboratory Evaluation of the Addition of Lime Treated Sand to Hot Mix Asphalt", TRB 73rd Annual Meeting, Washington D.C., 1994.

The first method is to add dry, hydrated lime to the aggregate with the lime and aggregate being mixed together prior to the addition of the asphalt binder. At batch plants, the lime is added to the aggregate in either the aggregate weigh box or in the pugmill. In drum plants, the lime is added inside the drum with either the asphalt binder or to the aggregate just prior to the addition of the asphalt binder.

In a second method, the dry hydrated lime is added to moist aggregate and mixed in a mixing drum or pugmill and is eventually dried to drive off the water prior to the addition of asphalt. The damp aggregate has about 3 to 5% moisture. Both of the first two methods require special handling techniques to minimize the loss of lime through dusting and to provide adequate ventilation to workers preparing the asphalt.

A third method of treating aggregate material with lime is by the use of a hydrated lime slurry. Here, hydrated lime is mixed with water to form a pumpable, low solids lime slurry. The lime slurry is then applied to the aggregate material. The aggregate/lime mixture is typically agitated to achieve a uniform distribution of the lime. This can be done with a pugmill, however, in some cases vigorous mixing is not necessary. The slurry added directly to the aggregate on a conveyor belt with a spray bar has sufficient fluidity to penetrate the aggregate stream prior to entering the dryer. A major problem with the use of the hydrated lime slurry is that the added excess water must be driven off, requiring large amounts of energy which adds to the cost of producing the hot mix asphalt.

In a fourth method, a quicklime slurry is formed by mixing together quicklime and an excess of water. The resultant lime slurry is added to the aggregate in a manner similar to the hydrated lime slurry. Typically, the amount of hydrated lime formed by the prior art techniques using quicklime slurry does not exceed about 20 to 30% lime solids. The treated aggregate must then be dried to remove the water from the aggregate mixture.

The present invention provides an improved method for preparing a hot quicklime slurry useful for treating the course or fine aggregate component of hot mix asphalt. In the discussion which follows, the term "quicklime" will be taken to mean calcium oxide and should not be confused with limestone (calcium carbonate). Quicklime is manufactured from limestone by heating to remove carbon dioxide. The remaining calcium oxide, called quicklime, is a very active chemical. To improve its handling characteristics, a controlled amount of water is often added to form calcium hydroxide, which is commonly called "hydrated" lime or hydrate. It is the quicklime form of the alkaline material which is used for purposes of the present invention, however.

The quicklime used in the present invention is mixed with an aqueous slaking medium to form a hot quicklime slurry. The term "slurry" will be taken to mean a colloidal suspension form of lime which has the consistency of thick cream. Unlike putty, it has no body or plasticity. It will flow and is pumpable, like a viscous liquid. It can be obtained by adding an extra increment of water when quicklime is slaked, usually about 1 part quicklime to about 2 parts water by weight. For purposes of the present invention, the hot quicklime slurry will contain greater than about 30% by weight lime solids, based upon the total weight of slurry. Preferably, the lime solids content of the hot quick lime slurry is in the range from about 30 to 60% by weight, more preferably in the range from about 32 to 40% by weight, based on the total weight of the quick lime slurry.

Portable equipment for forming lime slurries which can be moved from site to site, such as that described in U.S. Pat. No. 4,329,090 and which is hereby incorporated by reference, are known in the art. One of the advantages of using portable equipment is that hot lime slurries formed during the slaking of quicklime can be used almost immediately, before any significant temperature drop.

One of the shortcomings of the existing equipment is that the equipment produces lime slurries in individual batches. After one batch of lime slurry has been depleted, another batch must be made on site. This can take several minutes to several hours, delaying the supply of lime slurry. Often it is crucial to have a continuous, uninterrupted supply of lime slurry. In hot mix asphalt plants, for instance, the continuous feeding and control of lime is essential.

Referring to FIG. 1, an improved apparatus 10 used in performing the method of the invention is shown. This apparatus can supply the quicklime slurry which is used in the present inventive method on a continuous basis. The apparatus 10 has a primary tank 12 and an auxiliary tank 14 mounted on a frame structure 16. The apparatus 10 should be of legal highway size so that it can be transported on public roads or highways. The primary tank 12 should be large enough to process about 25 tons of dry quicklime, which is typically the maximum legal highway load for lime. A tank having a maximum capacity of 24,000 gallons is suitable to process 25 tons of dry quicklime. The auxiliary tank 14 has a capacity substantially less than that of the primary tank 12. A volume or capacity approximately one-third that of the primary tank 12 is sufficient for most operations. As an example, the tanks 12, 14 may be cylindrical tanks, each tank having a diameter of approximately 10.5 feet, with the primary tank 12 having a length of 30 feet and the auxiliary tank 14 having a length of 10 feet.

The frame structure 16 may be a skid on which the primary and auxiliary tanks 12 and 14 are mounted and which can be moved from place to place. Preferably, wheels (not shown) are mounted to the frame structure 16 to facilitate transporting the apparatus 10 to desired locations. As shown in FIG. 1, the primary and auxiliary tanks 12, 14 are concentric cylindrical tanks which are joined together and separated by a common wall 22. In the embodiment of FIG. 1, a single rotatable shaft 24 extends through both the primary and auxiliary tanks 12, 14 and through the common wall 22 which divides the primary and auxiliary tanks 12, 14. In other embodiments of the invention, each tank may be provided with a separate, individually operable mixing shaft. The rotatable shaft 24 is supported on bearings 28, 30 and 38. The bearing 28 located in the wall 22 is a sealed bearing which prevents fluid from escaping or flowing between the tanks 12, 14 through the wall 22.

Located along the length of the shaft 24, are a plurality of mixing paddles 32, 34. The paddles 32, 34 are arranged in a spiral pattern along the shaft. The paddles 32, 34 are angled to cause the particles of lime to flow along the length of the tanks 12, 14 and spirally intermix with the water. The paddles 32, 34 may be constructed of mild steel or any other suitably strong material and may be used in combination with flexible paddles, such as plastic, neoprene or other synthetic rubber. The paddles 32, 34 may also be belting having rubber around heat resistant fibers, like fiberglass fibers or the like. It is necessary that they be able to withstand the high temperatures which are often encountered in the slaking of quicklime. These temperatures may be near the boiling point of water.

The rotatable shaft 24 is rotated by means of a 100 horsepower electric motor 36 and conventional gearing. A rotational speed within the range of 30–90 revolutions per minute has been found to be satisfactory for mixing the lime slurry.

An inlet 42 is provided in the top of primary tank 12 and extends downward for a predetermined distance. After water is added to the tank 12 when forming the slurry, the inlet 42 will extend below a predetermined water level 44 for approximately 1 to 2 feet. Quicklime or hydrated lime may be introduced into the primary tank 12 through a feed hopper (not shown) or blown through a suitable pneumatic transport conduit (not shown) through the inlet conduit 42. A particulate scrubber 43 collects any dust in the tank space above water level 44. The introduction of the lime below the surface 44 of the water insures that the lime is thoroughly mixed and minimizes caking of the lime on the surface of the water.

The action of the mixing paddles 32 also insures that the slurry of lime is thoroughly slaked or mixed. The resulting reaction is highly exothermic with temperatures in the range from about 180° F. to 220° F., preferably below about 212° F. being reached. The lime slurry may then be introduced into the auxiliary tank 14 by means of a conduit 46 between and in communication with the primary and auxiliary tanks 12, 14. A valve 48 allows the conduit 46 to be selectively opened so that the lime slurry is introduced into the lime auxiliary tank 14. This may be accomplished without the use of a pump when the slurry level within the auxiliary is to be substantially the same as that in the primary tank. It may also be necessary to provide a pump in conjunction with the conduit 46 in order to pump the lime slurry to the auxiliary tank 14 if it is desirable that the lime slurry be at a higher level than that of the primary tank 12.

A suction line 52 with a valve 54 is provided with the primary tank 12 for drawing the lime slurry from the primary tank 12. The suction line 52 should have an inlet located at the bottom of the tank 12 to ensure complete drainage of the lime slurry. The auxiliary tank 14 also has a similar suction line 56 with a valve 58 for drawing lime slurry from the auxiliary tank 14. Both suction lines 52, 56 empty into a manifold 60. An effluent conduit 66 is provided with the manifold 60 for drawing a product stream from either the auxiliary or primary tanks 12, 14 through the manifold 60. A pump 68 pumps the effluent from the manifold 60 and conduit 66 to a conduit 70 where the product stream can be supplied to a desired area. In this case, as shown in FIG. 1, the desired area is the pugmill 74 of a hot mix asphalt plant. The asphalt plant also includes an aggregate feed bin 75 and an aggregate conveyor 77 for supplying aggregate to the pugmill 74. The treated aggregate passes out the outlet conveyor 79 to be dried and combined with the asphalt binder.

Provided with the primary tank 12 is an ultrasonic level indicator 76 which is electrically connected to the valves 54, 58 by process control unit 78. A level indicator 80 may also be provided with the auxiliary tank 14 and linked to the process control unit 78. The control unit 78 opens or closes the valves 54 and 58 to provide smooth and continuous effluent flow through the suction lines 52, 56, respectively. The control unit 78 may also connected to valve 48 on conduit 46.

In order to provide a continuous product stream of lime slurry, the apparatus 10 is transported to a desired area which is remote from a lime processing plant. Separate trucks or tanks are used to carry a supply of dry quicklime to be used in forming the lime slurry. Once the apparatus 10 is located at the remote job site, the primary tank 12 is filled with water through the inlet conduit 42 to the preselected level 44 from a suitable water source. When the primary tank 12 is filled with water, the quicklime may be blown or otherwise introduced into the primary tank 12. As this occurs, the water/lime mixture is stirred by means of the rotatable shaft 24 and the mixing paddles 32.

In forming lime slurries, the water used may vary in quality. Conventional water sources include city water mains, railroad storage facilities, highway department storage facilities, lakes, streams, and the like.

Typically, the amount of lime solids may range between 30–50% by weight to that of the total lime slurry. For example, 158,000 lbs. of water may be used to fill the tank to the preselected level 44. To this may be added 50,000 lbs. (25 tons) of lime. The lime used may be either a high calcium quicklime or a dolomitic quicklime. High calcium lime is usually preferable for most applications. The lime may have impurities but will ordinarily be greater than 90% calcium oxide.

In some cases, it may be desirable to add a soluble sulfate compound to the aqueous slaking medium contained within the mixing tank or to the quicklime prior to adding the quicklime to the slaking medium. Useful sulfate compounds include alkali metal and alkaline earth metal sulfates (e.g., potassium sulfate, calcium sulfate and sodium sulfate), organic sulfates (e.g., lignin sulphonate), sulfuric acid and mixtures thereof. Calcium sulfate can be added to the slaking medium in an amount ranging from about 0.5% to 5.0%, preferably about 1.0% to 2.0%, measured as a dry weight percent of the quicklime to be slaked.

Organic dispersants can also be added to the water prior to slaking or after slaking to lower the viscosity and increase the solids content of the slurry. Examples of suitable dispersants include the alkali metal salts of polyacrylic acid, for example sodium polyacrylate (SPAL) and potassium polyacrylate. However, due to the relative low cost and availability of sodium polyacrylate, sodium polyacrylate is a preferred dispersant. Other dispersing agents such as copolymers of polyacrylate are also effective. The resulting quick lime slurry has a lime solids content greater than about 40% by weight, based on the total weight of the slurry.

Once mixing of the lime slurry within the primary tank 12 is complete, rotation of the shaft 24 may be stopped. The valve 48 on conduit 46 is then opened either manually or by means of the control unit 78 so that the lime slurry is introduced into the auxiliary tank 14. As discussed previously, the lime slurry may either be pumped into the auxiliary tank 14 or merely allowed to flow from the primary tank 12 into the auxiliary tank 14 until the fluid levels within each tank 12, 14, as measured by the level indicators 76, 80, equilibrates. Once this occurs, the control unit 78 causes the valve 48 to close so that the supply of lime slurry within the primary tank 12 is effectively cut off from the auxiliary tank 14. With the valve 48 closed, the valve 54 on the suction line 52 is opened and the pump 68 is activated so that a product stream of the lime slurry from the primary tank 12 is drawn into the manifold 60, through effluent conduit 66 and out conduit 70 to the selected area 74. In FIG. 1, the selected area 74 is the pugmill of a hot mix asphalt plant.

When the level of the slurry in the primary tank 12 drops to a level where the primary tank 12 is nearly empty, the control unit 78 shuts the valve 54 to close suction line 52 and simultaneously opens the valve 58 on suction line 56. The lime slurry within the auxiliary tank 14 is thus introduced into the manifold 60 and through conduits 66 and 70 to the selected area 74. Thus, an uninterrupted, continuous supply of lime slurry is supplied. It should be noted that while the product stream of lime slurry is being drawn from either the primary tank 12 or the auxiliary tank 14, the rotatable shaft 24 and mixing paddles 32 can be rotated periodically to further mix the slurry and prevent settling of the lime solids.

While the lime slurry is being drawn from the auxiliary tank 14, a second batch of water and lime is introduced into the primary tank 12 through conduit 42 and mixed as discussed previously. Once the lime slurry has been mixed in primary tank 12, the valve 48 is opened once again to allow the new lime slurry to flow into the auxiliary tank 14 while the lime slurry is still flowing from the auxiliary tank 14. When the auxiliary tank 14 is full, the valve 58 is shut and the valve 54 is opened so that a second product stream of lime slurry flows into the manifold 60 from the primary tank 12 where it is pumped through conduit 70 to the selected area. Alternatively, after the second lime slurry is formed in the primary tank 12, valve 58 can be shut and valve 54 opened so that the second product stream can be drawn from the primary tank 12 immediately after it is formed. Valve 48 is then opened so that the auxiliary tank 14 is filled with lime slurry from the primary tank 12 as the second product stream is being drawn from the primary tank 12.

Thus, a continuous product stream can be created by switching to the auxiliary tank 14 while mixing another batch of lime and water to form a new lime slurry. It is important that the amount of lime slurry added to the auxiliary tank 14 should be equal to at least the value of the flow rate of the lime slurry flowing out of the auxiliary tank 14 multiplied by the amount of time required to mix a new batch of water and lime slurry. Typically, the amount of time required to prepare a lime slurry using 25 tons of lime is about one and a half hours. Thus, for example, if a continuous product stream of 40 gallons/min of lime slurry are required, and it takes one and a half hours (90 min) to prepare a new batch of lime slurry in the primary tank 12, the auxiliary tank 14 would have to hold at least 3600 gallons of the lime slurry.

An invention has been provided with several advantages. The hot mix asphalts of the invention have improved adhesion and cohesion properties due to the treatment of the aggregate with lime prior to adding the asphalt binder. The use of a hot quicklime slurry reduces dusting problems of the type encountered with dry hydrate. The higher solids, hot quicklime slurry minimizes the amount of added moisture which must be removed from the aggregate by drying prior to combining the aggregate and binder. The higher temperature of the hot quicklime slurry decreases the viscosity of the slurry to provide improved mixing of the lime particles with the aggregate. The hot quicklime slurries of the invention have a higher solids content than did prior art quicklime slurries produced in conventional slaking operations. The use of a portable slaking apparatus eliminates the need for costly tanks, silos and mixing equipment at the hot mix plant. The higher solids, hot quicklime slurry also decreases transportation costs for lime delivery to the job site. The auxiliary tank provided by the improved apparatus allows the supply of a continuous stream of hot quicklime slurry on site at the hot mix asphalt plant.

While the invention has been shown in only one of its forms, it is not thus limited but is susceptible to various changes and modifications without departing from the spirit thereof.

What is claimed is:

1. In a method of preparing a hot mix asphalt paving material containing sand, mineral aggregate material and asphalt binder, the improvement comprising a method of treating the mineral aggregate material to promote adhesion between the mineral aggregate material and the asphalt binder, the method comprising the steps of:

mixing together in a slurry mixing tank unslaked quicklime and an aqueous slaking medium to form a hot quicklime slurry by exothermic reaction, the resulting quicklime slurry having a lime solids content greater than about 30% by weight, based upon the total weight of the quicklime slurry; and treating the mineral aggregate material with the hot quicklime slurry while the slurry is at a temperature above ambient.

2. The method of claim 1, wherein the lime solids content of the quicklime slurry is in the range from about 35 to 60% by weight, based upon the total weight of the quicklime slurry.

3. The method of claim 2, wherein the quicklime slurry is added to the aggregate material when the quicklime slurry is at a temperature above ambient.

4. The method of claim 2, wherein the step of forming the hot quicklime slurry includes the step of adding a soluble sulfate compound to the slaking medium prior to contacting the quicklime with the slaking medium and then contacting the quicklime with the slaking medium to directly form a hot, flowable and pumpable lime slurry having a solids content greater than 32% by weight.

5. The method of claim 4, wherein the aqueous slaking medium is water.

6. The method of claim 4, wherein the soluble sulfate compound comprises a member selected from the group consisting of alkali metal sulfates and alkaline earth sulfates, organic sulfates, sulfuric acid and mixtures thereof.

7. The method of claim 6, wherein the soluble sulfate is calcium sulfate which is added to the aqueous slaking medium in an amount ranging from about 0.5% to about 5% by weight, based upon the dry weight of the quicklime.

8. The method of claim 4, further comprising the step of adding an organic dispersant to lower the viscosity and increase the solids content of the slurry.

9. In a method of preparing a hot mix asphalt paving material containing sand, mineral aggregate material and asphalt binder, wherein the mineral aggregate used in forming the hot mix asphalt composition is treated with an alkaline material to promote adhesion between the mineral aggregate material and the asphalt binder, the improved method comprising the steps of:

mixing together in a slurry mixing tank unslaked quicklime and an aqueous slaking medium to form a hot quicklime slurry by exothermic reaction, the resulting quicklime slurry having a lime solids content greater than about 40% by weight, based upon the total weight of the hot quicklime slurry;

applying the hot quicklime slurry to the mineral aggregate material;

drying the mineral aggregate material;

combining the treated and dried mineral aggregate material with the asphalt binder to form a hot mix asphalt.

10. In a method of preparing a hot mix asphalt paving material containing sand, mineral aggregate material and asphalt binder, wherein the mineral aggregate used in forming the hot mix asphalt composition is treated with an alkaline material to promote adhesion between the mineral aggregate material and the binder, the improved method comprising the steps of:

mixing together in a slurry mixing tank unslaked quicklime and an aqueous slaking medium to form a hot quicklime slurry at elevated temperature above ambient by exothermic reaction, the resulting hot quicklime slurry having a lime solids content greater than about 30% by weight, based upon the total weight of the quicklime slurry;

applying the hot quicklime slurry before said slurry cools below ambient temperature and while said hot slurry is at a temperature above ambient to the mineral aggregate material;

drying the aggregate material;

combining the treated and dried mineral aggregate material with the asphalt binder to form a hot mix asphalt.

11. The method of claim 10, wherein the lime solids content of the hot quicklime slurry is in the range from about 32 to 40% by weight, based upon the total weight of the hot quicklime slurry.

12. The method of claim 11, wherein the step of forming the hot quicklime slurry includes the step of adding a soluble sulfate compound to the slaking medium prior to contacting the quicklime with the slaking medium and then contacting the quicklime with the slaking medium to directly form a hot, flowable and pumpable lime slurry having a solids content greater than 32% by weight.

13. The method of claim 12, wherein the aqueous slaking medium is water.

14. The method of claim 12, wherein the soluble sulfate compound comprises a member selected from the group consisting of alkali metal sulfates and alkaline earth sulfates, organic sulfates, sulfuric acid and mixtures thereof.

15. The method of claim 14, wherein the soluble sulfate is calcium sulfate which is added to the aqueous slaking medium in an amount ranging from about 0.5% to about 5% by dry weight of the quicklime.

* * * * *